United States Patent [19]

Ravindran et al.

[11] Patent Number: 4,774,181

[45] Date of Patent: Sep. 27, 1988

[54] IMAGING ELEMENT CONTAINING FLUORESCENT DYE-RELEASING COUPLER COMPOUND

[75] Inventors: Nair N. Ravindran; Ramanuj Goswami, both of Rochester, N.Y.

[73] Assignee: Eastman Kodak Company, Rochester, N.Y.

[21] Appl. No.: 66,680

[22] Filed: Jun. 25, 1987

[51] Int. Cl.[4] ..... G03C 7/26; G03C 7/32; G03C 7/18

[52] U.S. Cl. ..... 430/359; 430/226; 430/543; 430/549; 430/553; 430/555; 430/557; 430/933

[58] Field of Search ..... 430/359, 226, 361, 139, 430/933, 553, 555, 557, 549, 543, 558

[56] References Cited

U.S. PATENT DOCUMENTS 2,449,966 9/1948 Hanson ..... 430/359
3,617,291 11/1971 Sawdey ..... 430/553

FOREIGN PATENT DOCUMENTS 945542 1/1964 United Kingdom .
945543 1/1964 United Kingdom .

OTHER PUBLICATIONS

Research Disclosure 17643, Dec. 1978, pp. 22–31.

*Primary Examiner*—Richard L. Schilling
*Attorney, Agent, or Firm*—Thomas F. Kirchoff

[57] ABSTRACT

An imaging element is described which comprises a dye image-forming coupler compound and a compound capable of releasing a fluorescent dye as a function of silver halide development. The released dye is capable of fluorescence which optically compensates for unwanted absorption of an image dye thereby resulting in color correction of the image.

13 Claims, No Drawings

IMAGING ELEMENT CONTAINING FLUORESCENT DYE-RELEASING COUPLER COMPOUND

This invention relates to photography. In particular, it relates to a photographic imaging element containing a fluorescent dye-releasing coupler compound. As a function of silver halide development, the coupler compound provides imagewise release of a dye which is capable of fluorescent emission which compensates or optically corrects for unwanted absorption of an image dye.

Dyes employed in imaging application are not ideal. They are known to be inefficient with respect to transmitting all of the electromagnetic radiation expected from theoretical considerations. Whereas a dye which is capable of absorbing radiation in a given region of the spectrum should ideally transmit radiation in all other regions of the spectrum, practical experience shows that such expectations are not realized. For example, a yellow image dye is expected to absorb radiation in the blue region of the visible spectrum and to transmit radiation in the green and red regions. In reality, yellow dyes also absorb some radiation in both the green and red regions of the electromagnetic spectrum.

Unwanted absorption is also associated with magenta and cyan dyes, as well as with dyes having principal absorption properties in regions of ultraviolet and infrared radiation. The result of this phenomenon is that unwanted absorption is introduced to an imaging element or process, thereby adversely affecting the quality of the resulting image.

Efforts to correct this unwanted absorption problem have focused on techniques which utilize preformed dyes as color masking agents. Such techniques are described in U.S. Pat. No. 2,449,966 and in *Research Disclosure,* Publication 17643, Paragraph VII, December, 1978. Preformed dyes, particularly when incorporated in silver halide emulsion layers, inasmuch as they are already colored, act as filters by absorbing a portion of the radiation which otherwise is intended to be absorbed by silver halide. This results in loss of photographic sensitivity.

One way of eliminating unwanted absorption is to coat the silver halide and the dye in separate layers. However, this solution has the adverse effect of increasing the number of layers in an imaging element which adversely affects not only the imaging process but also the manufacturing operation.

In British Patent Specification No. 945,542 there is described a photosensitive silver halide emulsion layer comprising a color coupler compound which has attached, to the coupling position thereof, a substituent which imparts fluorescence to the coupler compound. The substituent is attached in such a manner as to be capable of being removed from the layer by reaction with oxidized developing agent. After color development the developed layer remains fluorescent only in those areas where no color development has taken place. This produces a subtractively colored image which fluoresces wherever unused color coupler remains. The optical effect from this residual image, as viewed by reflected light, is an apparent reduction in the density in low density areas. This British Patent specification contains no teaching or suggestion for the production of fluorescent dye only in those areas where color development has taken place in order to compensate optically for unwanted absorption.

U.S. Pat. No. 3,617,291 describes development inhibitor releasing 2-equivalent coupler compounds which are capable of absorbing UV radiation and of fluorescing in the blue region of the visible spectrum. Following development, incorporated coupler remaining in the background areas of a developed color photographic print will fluoresce to impart a brightening effect to such areas of the processed prints. This patent does not disclose or suggest production of a fluorescent dye only in those areas where color development has taken place in order to compensate optically for areas of unwanted absorption.

Accordingly, it is desirable to provide a means to compensate optically for unwanted dye absorption without loss of desirable imaging properties.

The present invention resides in an imaging element comprising a support and a photosensitive silver halide emulsion layer comprising a dye image-forming coupler compound which, upon silver halide development, yields an image dye having a desired absorption in a first region of the spectrum and an undesired absorption in a second region of the spectrum, the improvement wherein the element comprises a compound which, as a function of development, releases a dye which fluoresces in a region of the spectrum to compensate optically for the unwanted absorption of the image dye.

The present invention also provides a process of color correction which comprises the steps of:

(a) exposing an imaging element which comprises a support and a photosensitive silver halide emulsion layer comprising a dye image-forming coupler compound which, upon silver halide development, yields an image dye having a desired absorption in a first region of the spectrum and an undesired absorption in a second region of the spectrum, said silver halide emulsion layer having associated therewith a compound which, as a function of development, releases a dye which fluoresces in a region of the spectrum to compensate optically for the unwanted absorption of the image dye, and then (b) developing the imagewise-exposed areas of the element with developing agent, thereby releasing the dye which fluoresces in a region of the spectrum to compensate optically for such unwanted absorption.

The dye image-forming coupler compound can be separate and distinct from the compound which is capable of releasing a dye having fluorescent properties. In the case, where separate compounds are used, the dye image-forming coupler compound can be any compound which is known to be useful for such purpose. The function of such coupler compound, in an imaging element as described herein, is unchanged from prior known uses with respect to image-forming properties in photographic applications.

The dye image-forming coupler compound can also be the compound which, as a function of silver halide development, releases a dye which is capable of fluorescing to compensate optically for unwanted absorption. In this instance, the desired dye image is formed as a result of reaction of oxidized color developing agent with the coupler moiety of the dye image-forming coupler compound during and after it has been severed from an attached dye moiety. This later dye moiety, after separation from the dye image-forming coupler compound, is then capable of fluorescing to provide the desired optical compensation for unwanted absorption.

The fluorescent dye releasing compound, which provides the dye capable of fluorescence to compensate optically for unwanted absorption, can be represented by the formula:

COUP
|
DYE wherein:

COUP represents a coupler moiety which is capable of forming an image dye upon reaction with oxidized primary amino color developing agent; and DYE represents a dye moiety which is bonded to COUP through a di- or trivalent hetero atom and, when severed from COUP, is capable of fluorescence which compensates for unwanted absorption of image dye, thereby optically correcting such unwanted absorption.

Requirements of a DYE moiety for use in this invention include the need that, while bonded to COUP, it be optically colorless, that it not fluoresce, that it be capable of absorbing radiation in a relatively shorter wavelength region and, after release from COUP, be capable of fluorescence in a relatively longer wavelength region.

Selection of the DYE moiety is at least in part dictated by the unwanted absorption of the image dye. For example, where a yellow dye- forming coupler is employed which, upon reaction with oxidized primary amino color developing agent, yields a dye having maximum absorption in the region of about 440 to 460 nm, but which also has undesirable green absorption, the selected DYE moiety, when released, should be capable of fluorescing in a manner sufficient to provide optical compensation relative to the unwanted green absorption.

Optical compensation for correction of unwanted absorption does not require a dye which fluoresces in the same wavelength region as that of the unwanted absorption. It has been preceived that optical compensation can sometimes be provided where fluorescence of the dye is either in a shorter or a longer wavelength region thnt that of the unwanted image dye absorption.

The hetero atom through which DYE is bonded to COUP can be a non-metallic atom of groups VA or VIA of the periodic table in its −2 or −3 valence state. Typical examples of such atoms are oxygen, sulfur and nitrogen. Where the hetero atom is trivalent, it can be substituted with a hydrogen atom, an alkyl group having from 1 to about 10 carbon atoms or an aryl group having from 6 to about 12 carbn atoms. As a result of silver halide development, the bond between the COUP and DYE moieties is severed in an imagewise manner thereby releasing DYE with the hetero atom attached thereto. DYE, when so released, is capable of fluorescence and is thereby optically able to compensate for unwanted absorption of the imaging dye formed as a result of reaction of the COUP moiety with oxidized color developing agent.

DYE moieties which meet the requirements noted above are described in the following literature references: (1) *Recent Progress Chem. Nat. and Synth. Colouring Matters and Related Fields;* (2) Gore, Joshi, Sunthankar and Tilak editors, Academic Press, New York, N.Y., 1962, pp 1-11; (3) *Angewandte Chemie International Edition in English,* Vol. 14 (1975) No. 10, pp 665-679; (4) Kirk-Othmer *Encyclopedia of Chemical Technology,* Third Edition, Vol. 4, pp 213-226, John Wiley & Sons, 1978; (5) Cooke et al, *Australian J. Chem.,* 28, pp 1053-1057 (1975); (6) Cooke et al, *Australian J. Chem.,* 30, pp 2241-2247 (1977); (7) Chaffee et al, *Australian J. Chem.,* 34, pp 587-598 (1981); (8) Cooke et al, *Australian J. Chem.,* 11, pp 230-235 (1958) and (9) European Patent Specification No. 060518B1, published July 17, 1985.

The following structural formulae represent specific DYE moieties, which can be used in the imaging elements described herein:

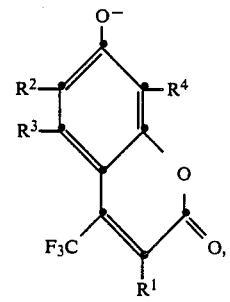

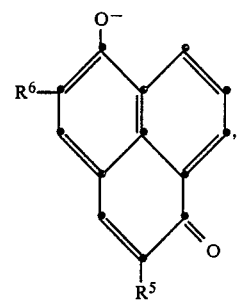

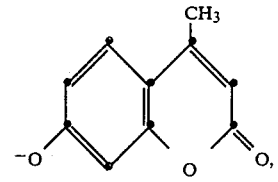

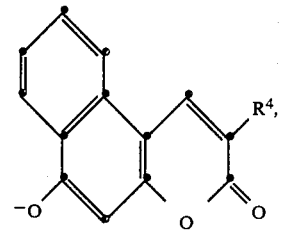

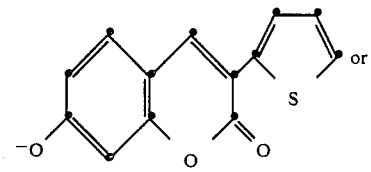

-continued

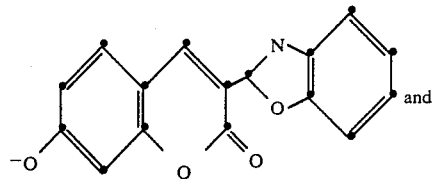

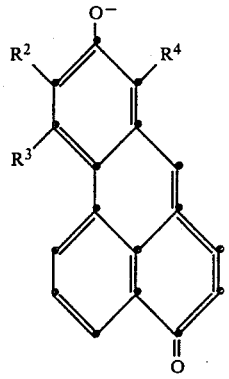

wherein $R^1$ is hydrogen, alkyl having from 1 to about 12 carbon atoms, preferably from 1 to about 6 carbon atoms, aryl having from 6 to about 12 carbon atoms, or $R^1$ can be the group $-(CH_2)_nW$ where n is 0 or from 1 to 3 and W can be —CN, $-CO_2R^7$, $-SO_2R^7$ or $-NR^7R^8$ where $R^7$ is alkyl having from 1 to about 12 carbon atoms, preferably from 1 to about 6 carbon atoms and $R^8$ is hydrogen or as defined for $R^7$;

$R^2$ is hydrogen, chlorine or fluorine;

each of $R^3$ and $R^4$, independently, is a substituent which does not quench fluorescence in the DYE moiety, and can be hydrogen, alkyl or alkoxy having from 1 to about 12 carbon atoms, preferably an alkyl or alkoxy group having from 1 to about 6 carbon atoms, or a carboalkoxy group where the alkoxy moiety has from 1 to about 12 carbon atoms;

each of $R^5$ and $R^6$, independently is hydrogen, an alkyl or an alkoxy group having from 1 to about 12 carbon atoms, preferably from 1 to about 6 carbon atoms, —CN or $-SO_2R^7$ where $R^7$ is as defined above.

Where $R^1$ is aryl, it is preferably a phenyl or a benzyl group. While the aryl group can be substituted, it has been found that improved quantum efficiency values are obtained when the aryl group is unsubstituted. However, where substituents are present, these can be alkyl groups having from 1 to about 12 carbon atoms, the important consideration being that an alkyl group not quench fluorescence in the dye.

As is apparent from the foregoing explanations, the origin of COUP can be from the dye image-forming coupler compound which is separate and distinct from the compound which releases a dye capable of fluorescing, or COUP can be provided by the same compound which supplies the DYE moiety.

Many COUP moieties are known. The dyes formed therefrom generally have their main absorption in the red, green or blue regions of the visible spectrum. For example, couplers which form cyan dyes upon reaction with oxidized color developing agents are described in such representative patents and publications as: U.S. Pat. Nos. 2,772,162, 2,895,826, 3,002,836, 3,034,892, 2,474,293, 2,423,730, 2,367,531, 3,041,236 and "Farbkuppler-eine Literaturübersicht," published in Agfa Mitteilungen, Band II, pp. 156–175 (1961).

Preferably such couplers are phenols and naphthols which form cyan dyes on reaction with oxidized color developing agent and have a linking group attached to the coupling position, i.e. the carbon atom in the 4-position of the phenol or naphthol. Structures of such preferred cyan coupler moieties are:

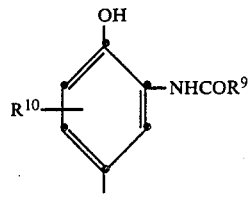

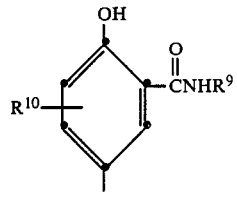

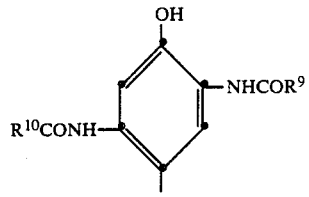

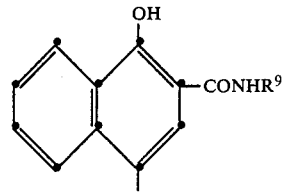

where $R^9$ represents a ballast group, and $R^{10}$ represents one or more halogen (e.g. chloro, fluoro), alkyl having from 1 to 4 carbon atoms or alkoxy having from 1 to 4 carbon atoms.

Couplers which form magenta dyes upon reaction with oxidized color developing agent are described in such representative patents and publications as: U.S. Pat. Nos. 2,600,788, 2,369,489, 2,343,703, 2,311,082, 3,824,250, 3,615,502, 4,076,533, 3,152,896, 3,519,429, 3,062,653, 2,908,573 and "Farbkuppler-eine Literaturü bersicht," published in Agfa Mitteilungen, Band II, pp. 126–156 (1961).

Preferably such couplers are pyrazolones and pyrazolotriazoles which form magenta dyes upon reaction with oxidized color developing agents and which have a linking group attached to the coupling position, i.e. the carbon atom in the 4-position. Structures of such preferred magenta coupler moieties are:

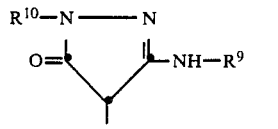

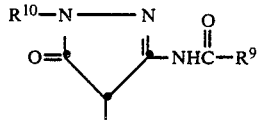

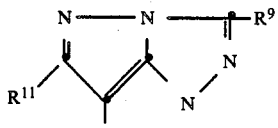

wherein $R^9$ is as defined above and $R^{11}$ is phenyl or substituted phenyl, such as for example 2,4,6-trihalophenyl.

Couplers which form yellow dyes upon reaction with oxidized color developing agent are described in such representative patents and publications as: U.S. Pat Nos. 2,875,057, 2,407,210, 3,265,506, 2,298,443, 3,048,194, 3,447,928 and "Farbkuppler-eine Literaturübersicht," published in Agfa Mitteilungen, Band II, pp. 112–126 (1961).

Preferably such yellow dye-forming couplers are acylacetamides, such as benzoylacetanilides and pivalylacetanilides. These couplers have a linking group attached to the coupling position, i.e. the active methylene carbon atom.

Structures of such preferred yellow coupler moieties are:

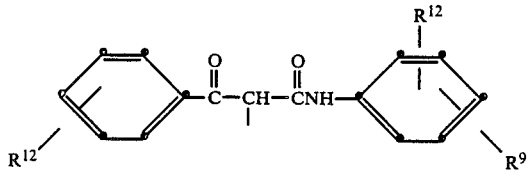

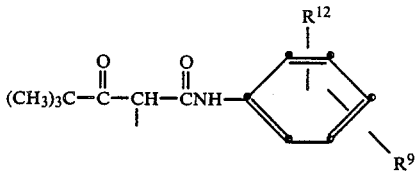

where $R^9$ is as defined above and $R^{12}$ is hydrogen, one or more halogen atoms, or an alkyl group having from 1 to 20 carbon atoms.

As noted above, substituents on the COUP moieties include ballast groups. Such groups prevent a COUP moiety, including attachments thereto such as DYE, from migrating throughout a photographic imaging element.

After release from COUP, DYE can be restrained from migrating into other layers of an imaging element by use, on the DYE moiety, of a relatively large substituent which serves effectively as a ballast group. Another means of restraining migration is by use of a mordant in the layer containing COUP-DYE. The released DYE will react with the mordant and be chemically bonded thereto, thus restraining it from diffusing throughout the imaging element.

Typical mordants which can be used include mixtures of polyvinyl alcohol and poly-4-vinyl pyridine, as described in U.S. Pat. No. 3,148,061; polymers of aminoguanidine derivatives of vinylmethyl ketone, as disclosed in U.S. Pat. No. 2,882,156; as well as poly-2-vinylpyridine compounds as disclosed in U.S. Pat. No. 2,484,430.

Particular coupler compounds capable of releasing a fluorescent DYE moiety in accordance with this invention include the following where, in each compound, the hetero atom bonding COUP with LINK is an oxygen atom:

Compound 1

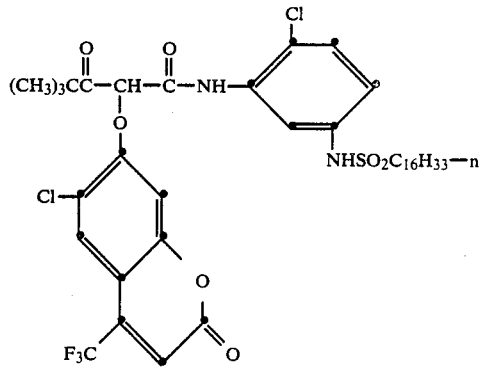

Compound 2

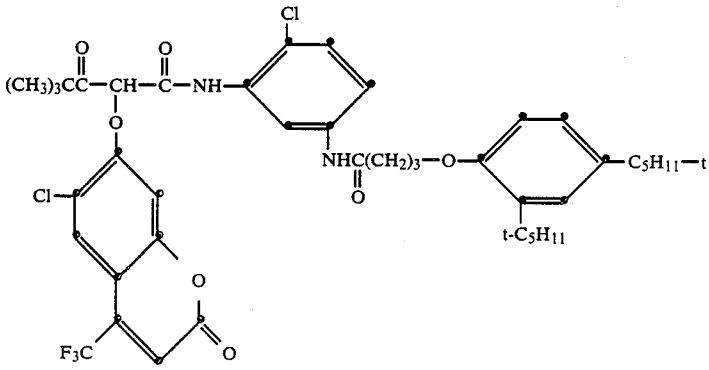

Additional coupler compounds capable of releasing DYE moieties which are capable of fluorescing are noted in the following Table:

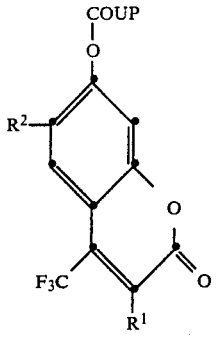

| Compound No. | $R^1$ | $R^2$ | COUP |
|---|---|---|---|
| 3 | —H | —H | A |
| 4 | 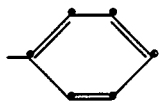 | —H | A |
| 5 | 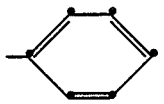 | —Cl | A |
| 6 | —$CH_3$ | —H | B |
| 7 | —$CH_3$ | —Cl | B |
| 8 | —$CO_2C_2H_5$ | —H | A |
| 9 | —$CO_2C_2H_5$ | —Cl | A |
| 10 | —$CH_2CO_2C_2H_5$ | —H | B |
| 11 | —$CH_2CO_2C_2H_5$ | —Cl | B |

Each compound of the above Table comprises a COUP which is a yellow dye-forming moiety and which also has a ballast group attached thereto. These ballasted COUP moieties have the following structural formulae:

COUP A

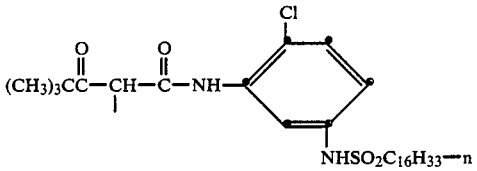

COUP B

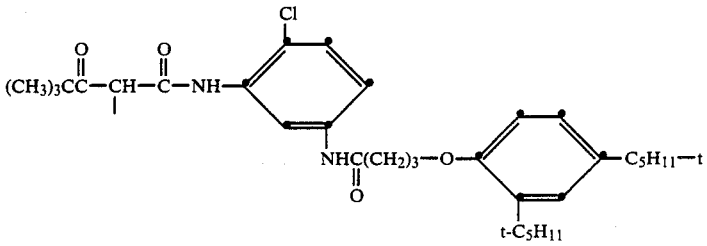

The following examples are representative of the preparation of coupler compounds as described herein and of use of such compounds in image recording materials. Other compounds falling within the scope of this invention can be used in a similar manner. Unless otherwise indicated all parts, percents and ratios are by weight.

Preparation I

This illustrates the synthesis of Compound No. 2 as identified above.

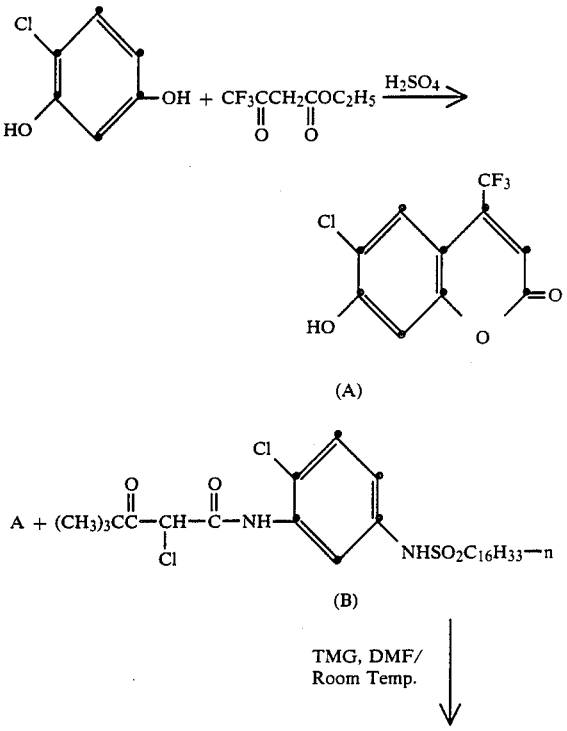

-continued

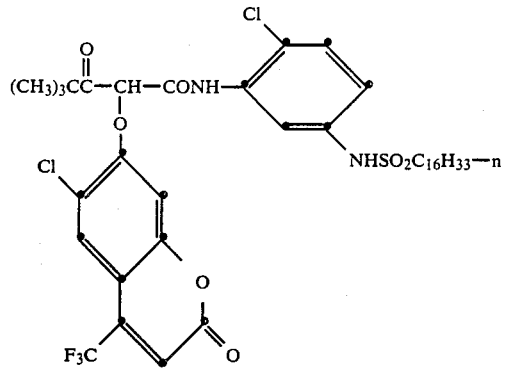

Compound No. 2

Preparation of A

A methanol solution (20 ml) of 4-chlororesorcinol (7.3 g, 50.5 mmole) and ethyl-4,4,4-trifluoroacetoacetate (93 g, 50.5 mmole) was slowly added with stirring to 30 ml of concentrated sulfuric acid. After heating for 4 hours at 90° C., the dark solution was cooled to room temperature and poured slowly into ice water. Crude product A was collected by filtration, washed with water and recrystallized from methanol/water; yield 9.0 g (67.3%), m.p. 180°-183° C.

Anal. Calcd for: C, 45.4; H, 1.5. Found: C, 45.7; H, 1.5.

Preparation of B

Phenolic fluorescent compound A (2.7 g, 10.2 mmole) and chloro coupler B (12.0 g, 20.3 mmole) were dissolved in dimethyl formamide (100 ml) and combined with tetramethyl guanidine (TMG) (7.0 g, 60.9 mmole). The reaction mixture was stirred for 112 hours at room temperature, poured into hydrochloric acid (1N, 200 ml) and then extracted with ethyl acetate. The ethyl acetate extract was washed with water, dilute sodium bicarbonate and a saturated sodium chloride solution. The crude reaction product was purified via flash chromatography (silica gel; initial eluent: 1:1 cyclohexane:dichloromethane). The combined fractions were partitioned against dilute sodium bicarbonate containing 0.1N $NH_4OH$ solution. The fractions were combined to yield 3.0 g (35.9%) of Compound No. 2.

Imaging elements of this invention in which the described coupler compounds are incorporated can be elements comprising a support and one or more silver halide emulsion layers. The coupler compounds are preferably incorporated in a silver halide emulsion layer. However, they can be incorporated in another layer, such as a layer adjacent a silver halide layer, where they will come into reactive association with oxidized color-developing agent which contains developed silver halide. Additionally, a silver halide emulsion layer and an adjacent layer containing the coupler compound can contain addenda conventionally contained in such layers.

Improved image reproduction can be obtained in a variety of imaging elements utilizing this invention. In each instance optical compensation for unwanted absorption is obtained by imagewise release of a fluorescent dye.

The practice of this invention is possible in single color or in multicolor imaging elements. The layers of the imaging element, including the layers of separate image-forming units, can be arranged in various orders as known in the art.

In a preferred embodiment, the imaging element of this invention is a multicolor photographic element comprising a support having thereon a red-sensitive silver halide emulsion layer having associated therewith a cyan dye image-forming coupler compound, a green sensitive silver halide emulsion layer having associated therewith a magenta dye image-forming coupler compound, and a blue- sensitive silver halide emulsion layer having associated therewith a yellow dye image-forming coupler compound, at least one of said emulsion layers also having associated therewith a fluorescent dye-releasing coupler compound which, as a function of silver halide development, imagewise releases a dye which is capable of fluorescence which compensates for unwanted absorption of an image dye.

The coupler compounds described herein can be incorporated into or associated with one or more layers of the element. The element can contain additional layers such as filter layers, interlayers, overcoat layers or subbing layers.

In the following discussion of suitable materials for use in the elements of this invention, reference will be made to Research Disclosure, December 1978, Item 17643, published by Industrial Opportunities Ltd., Homewell Havant, Hampshire, PO9 1EF, U.K., the disclosures of which are incorporated herein by reference. This publication will be identified hereafter by the term "Research Disclosure."

The silver halide emulsions employed in the elements of this invention can be either negative-working or positive-working. Suitable emulsions and their preparation are described in Research Disclosure Sections I and II, and the publications cited therein, and can include coarse, medium or fine grains or mixtures thereof. The grains may be of different morphologies, e.g, spherical, cubic, cubooctrahedral, tabular, etc., or mixtures thereto. Grain size distribution may be monodisperse or polydisperse or mixtures thereof. Such silver halides include silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the grains. They can be chemically and spectrally sensitized. The emulsions preferably contain gelatin, although other natural or synthetic hydrophilic colloids, soluble polymers or mixtures thereof can be used.

Suitable vehicles for the emulsions layers and other layers of elements of this invention are described in Research Disclosure Section IX and the publications cited therein.

In addition to the coupler compounds described herein the elements of this invention can include additional couplers as described in Research Disclosure Section VII, paragraphs D, E, F and G and the publications cited therein.

The imaging elements of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section XI), plasticizers and lubricants (Research Disclosure Section XII), antistatic agents (Research Disclosure Section XIII), matting agents (Research Disclosure Section XVI) and development modifiers (Research Disclosure Section XXI).

The imaging elements can be coated on a variety of supports as described in Research Disclosure Section XVII and the references described therein.

The described imaging elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and to oxidize the color developing agent. Oxidized color developing agent in turn reacts with the coupler to yield a dye.

Particularly useful color developing agents include aminophenols, phenylenediamines, tetrahydroquinolines as described, for example, in *Research Disclosure,* December 1978, Item 17643, paragraph XX, published by Industrial Opportunities Ltd., Homewall Havant, Hampshire PO9 IEF, UK, the disclosures of which are incorporated herein by reference. Other compounds including hydroquinones, catechols and pyrazolidones are useful as auxiliary developing agents.

The term "associated therewith" as used herein is intended to mean that the materials can be in either the same or different layers so long as the materials are accessible to one another.

The following examples are intended as further illustrations of this invention.

Examples 1–4

Examples 1 to 4 illustrate this invention in conjunction with a coupler compound (X) which forms a yellow, non-fluorescent dye by reaction with oxidized color developing agent.

The following layers were coated in the order indicated on a cellulose acetate film support.

1. A coarse-grain, polydispersed, sulfur plus gold sensitized AgBrI (88:12) emulsion (1.35 g Ag/m$^2$, 2.69 g gel/m$^2$) and α-pivalyl-α-[4-(4-benzyloxyphenyl-sulfonyl)phenoxy]-2-chloro-5-(n-hexadecylsulfonamide)-acetanilide dye forming coupler compound X (structure presented below).

2. Gelatin (1.08 g/m$^2$), poly[styrene-co-N-vinylbenzyl-N,N-dime chlorideco-divinylbenzene](1.08 g/m$^2$) and bis(vinylsulfonylmethyl)ether (1.75% of total gel coverage).

The dried coating (Example 1) was exposed (.01 sec/500W, 5500°0 K., WR2B) through a graduated density step wedge and processed at 38° C. according to the procedure described for the Kodak C-41 process in the British J. Photography 1982 Annual, pp. 209–11.

Additional examples were prepared as described above except that varying amounts (see following Table I) of fluorescent dye releasing coupler Compound No. 2 were employed in place of or in combination with Coupler compound X.

TABLE I

| | Coupler Compound, g/m$^2$ | | % Total Radiance Factor* | |
|---|---|---|---|---|
| Example | X | 2 | 500 nm | 550 nm |
| 1 | 0.75 | — | 27 | 66 |
| 2 | — | 0.75 | 39 | 70 |

TABLE I-continued

| | Coupler Compound, g/m$^2$ | | % Total Radiance Factor* | |
|---|---|---|---|---|
| Example | X | 2 | 500 nm | 550 nm |
| 3 | 0.38 | 0.38 | 33 | 69 |
| 4 | 0.53 | 0.23 | 30 | 68 |

*Total Radiance Factor: This measurement was obtained by placing the exposed and processed strips on a white backing, illuminating with white light and measuring the % reflectance at wavelength intervals using a monochromator.

The data in Table I shows that at 500nm, using only Coupler Compound X, there is a 27% reflection of light thus indicating a 73% absorption of light at this region of the spectrum. Use of only dye image-forming Coupler compound 2 of this invention shows a 39% reflection, thus indicating a 61% absorption of light at this wavelength. The 44% increase in reflection by Coupler Compound 2, which is readily perceived by visual examination, is attributed to optical compensation caused by fluorescence of the dye released from Coupler Compound 2.

Use of mixtures of Coupler Compounds X and 2 (Examples 3 and 4) show the positive effects of optical compensation for unwanted absorption which are attributable to Coupler Compound 2. The reflection values at 550nm show there is much less undesired green light absorbed by either of the dyes derived from the coupler compounds tested so that optical compensation at this region of the spectrum is not needed.

The structural formula of dye forming coupler compound X is as follows:

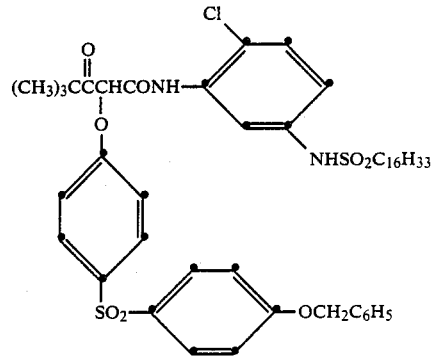

Similar effects were obtained when the fluorescent dye image releasing coupler was employed in a color paper format using a halide converted emulsion and a yellow dye-forming coupler.

The invention has been described in detail with particular reference to preferred embodiments thereof, but it will be understood that variations and modifications can be effected within the spirit and scope of the invention.

What is claimed is:

1. An imaging element comprising a support and a photosensitive silver halide emulsion layer comprising a dye image-forming coupler compound which, upon silver halide development, yields an image dye having a desired absorption in a first region of the spectrum and an undesired absorption in a second region of the spectrum, the improvement wherein the element comprises a non-fluorescent compound which, as a function of development, releases a dye which fluoresces in a region of the spectrum to compensate optically for unwanted absorption of the image dye, the fluorescent dye releasing compound being represented by the formula:

COUP
|
DYE wherein:

COUP represents a coupler moiety which is capable of releasing DYE upon reaction with oxidized primary amino color developing agent; and DYE represents a dye moiety which is bonded to COUP through a di- or trivalent hetero atom and, when so bonded, does not fluoresce, but when severed from COUP, is capable of fluorescence.

2. The imaging element of claim 1 wherein the dye image-forming coupler compound is distinct from the compound which releases a dye capable of fluorescing.

3. The imaging element of claim 1 wherein the coupler compound releases one of the following DYE moieties:

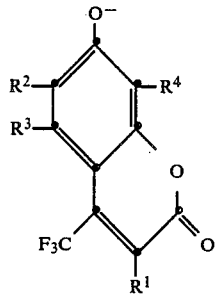

or

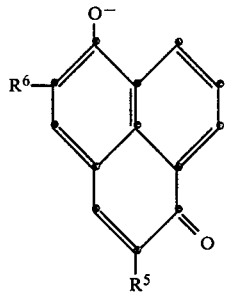

wherein:

$R^1$ is hydrogen, alkyl having from 1 to about 12 carbon atoms, aryl having from 6 to about 12 carbon atoms, or $R^1$ can be the group $-(CH_2)_nW$ where n is 0 or from 1 to 3 and W can be —CN, $-CO_2R^7$, $-SO_2R^7$ or $-NR^7R^8$ where $R^7$ is an alkyl group having from 1 to about 12 carbon atoms and $R^8$ is hydrogen or as defined for $R^7$;

$R^2$ is hydrogen or chlorine or fluorine;

each of $R^3$ and $R^4$, independently, is a substituent which does not quench fluorescence in the dye;

each of $R^5$ and $R^6$, independently is hydrogen, an alkyl or an alkoxy group having from 1 to about 12 carbon atoms, —CN or $-SO_2R^7$, where $R^7$ is an alkyl group having from 1 to about 12 carbon atoms.

4. The imaging element of claim 3 wherein $R^1$ is $-(CH_2)_nW$, n is 0 or from 1 to 3, W is $-CO_2R^7$ and $R^7$ is alkyl having from 1 to 6 carbon atoms.

5. The imaging element of claim 3 wherein $R^2$ is hydrogen or chlorine.

6. The imaging element of claim 3 wherein each of $R^3$ and $R^4$, independently, is hydrogen or alkyl or alkoxy having from 1 to about 12 carbon atoms.

7. The imaging element of claim 6 wherein each of $R^3$ and $R^4$, independently, is alkyl or alkoxy having from 1 to about 6 carbon atoms.

8. The imaging element of claim 1 wherein DYE is bonded to COUP through an oxygen, sulfur or nitrogen atom.

9. The imaging element of claim 8 wherein DYE is bonded to COUP through an oxygen atom.

10. The imaging element of claim 1 which is a multicolor photographic element comprising a support having thereon a red-sensitive silver halide emulsion layer having associated therewith a cyan dye image-forming coupler compound, a green sensitive silver halide emulsion layer having associated therewith a magenta dye image-forming coupler compound, and a blue-sensitive silver halide emulsion layer having associated therewith a yellow dye image-forming coupler compound, at least one of said emulsion layers also having associated therewith a non fluorescent compound which, as a function of silver halide development, imagewise releases a dye which is capable of fluorescence which compensates for unwanted absorption of an image dye.

11. The imaging element of claim 1 wherein the compound which releases a fluorescent dye has the structural formula:

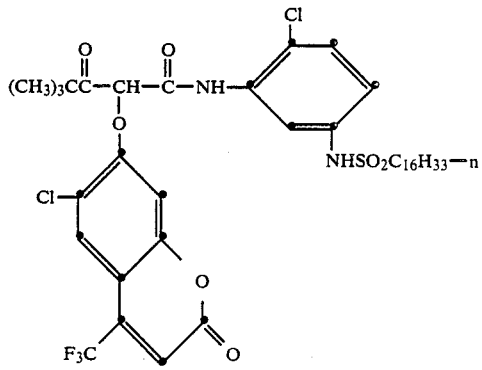

12. The imaging element of claim 1 wherein the compound which releases a fluorescent dye has the structural formula:

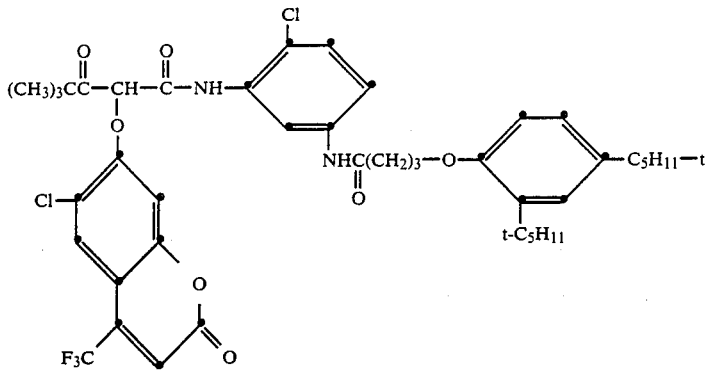

13. A process of color correction which comprises the steps of:

(a) exposing an imaging element which comprises support and a photosensitive silver halide emulsion layer comprising a dye image-forming coupler compound which, upon silver halide development, yields an image dye having a desired absorption in a first region of the spectrum and an undesired absorption in a second region of the spectrum, said silver halide emulsion layer having associated therewith a non-fluorescent compound which, as a function of development, releases a dye which fluoresces in a region of the spectrum to compensate optically for the unwanted absorption of the image dye, the fluorescent dye releasing compound having the formula:

COUP
|
DYE wherein:

COUP represents a coupler moiety which is capable of releasing DYE upon reaction with oxidized primary amino color developing agent; and DYE represents a dye moiety which is bonded to COUP through a di- or trivalent hetero atom, and when so bonded, does not fluoresce, but when severed from COUP, is capable of fluorescence, and then (b) developing the imagewise-exposed areas of the element which developing agent, thereby releasing DYE which fluoresces in a region of the spectrum to compensate optically for such unwanted absorption.

* * * * *